United States Patent [19]

Tsukada et al.

[11] Patent Number: 4,496,238

[45] Date of Patent: Jan. 29, 1985

[54] IMAGE RECORDING APPARATUS

[75] Inventors: Masaharu Tsukada, Kawasaki; Junichi Kimizuka; Haruo Shimizu, both of Yokohama, all of Japan

[73] Assignee: Canon Kabushiki Kaisha, Tokyo, Japan

[21] Appl. No.: 482,893

[22] Filed: Apr. 7, 1983

[30] Foreign Application Priority Data

Apr. 15, 1982 [JP] Japan ..... 57-54726[U]

[51] Int. Cl.[3] ..... G03G 15/00

[52] U.S. Cl. ..... 355/14 D

[58] Field of Search ..... 355/14 D, 14 R, 14 SH, 355/3 SH, 3 DD, 3 TR, 3 R

[56] References Cited

U.S. PATENT DOCUMENTS 4,239,372 12/1980 Iwai ..... 355/14 D
4,239,374 12/1980 Tatsumi et al. ..... 355/14 D
4,314,755 2/1982 Kinashi ..... 355/14 D
4,332,877 6/1982 Tabata ..... 355/14 D
4,395,112 7/1983 Miyakawa et al. ..... 355/14 D

FOREIGN PATENT DOCUMENTS 0121453 9/1980 Japan ..... 355/14 D

*Primary Examiner*—R. L. Moses
*Attorney, Agent, or Firm*—Fitzpatrick, Cella, Harper & Scinto

[57] ABSTRACT

This specification discloses an image recording apparatus provided with a developing sleeve for guiding and supplying charged toner to cause the charged toner to adhere to an electrostatic latent image on the surface of a photosensitive medium, and means for detecting the feed of multiple transfer sheets, wherein the developing sleeve is provided so as to enable the change over to a potential for releasing the supply of the toner to the photosensitive medium by the adherence of the toner thereto and the change-over is effected in response to the detecting operation of the multi-copy feed detecting means.

2 Claims, 5 Drawing Figures

IMAGE RECORDING APPARATUS

BACKGROUND OF THE INVENTION

1. Field of the Invention

This invention relates to improvements in an image recording apparatus having means for detecting the feed of multiple transfer members (hereinafter referred to as the transfer paper or copy paper), and more particularly to the processing when multi-copy feed is detected by the multi-copy feed detecting means.

2. Description of the Prior Art

It is generally known that when multi-copy feed has occurred during the image recording operation in an image recording apparatus, a trouble such as twining of copy paper around the drum which is a photosensitive medium is liable to occur near the drum.

When such a trouble has occurred, the user must of course remove the copy paper stagnant in the apparatus and in such case, if developer (hereinafter referred to as the toner) adheres to the copy paper or the drum, it may contaminate the user's clothes or may bring about hygienically undesirable conditions due to scattering of the toner or the like. U.S. Pat. No. 3,396,965, etc. propose various contrivances for detection or prevention of multi-copy feed, but do not propose a method of preventing scattering of the toner during the copy paper removing work after multi-copy feed has occurred.

It is attributable to the toner resting in a ready-to-scatter condition on the copy paper which is a toner image bearing member or on the surface of the drum which is a photosensitive medium that the toner scatters to bring about the undesirable conditions when the copy paper stagnant in the apparatus is removed upon occurrence of the aforementioned trouble. Accordingly, if the supply of the toner in such ready-to-scatter condition can be released, it will be very effective to eliminate the above-mentioned difficulty.

SUMMARY OF THE INVENTION

It is an object of the present invention to provide an improved image recording apparatus provided with multi-copy feed detecting means.

It is another object of the present invention to prevent toner from scattering from the copy paper or the photosensitive medium when multi-copy feed has occurred.

It is still another object of the present invention to prevent unnecessary consumption of the toner.

The present invention which achieves these objects is an image forming apparatus having a developer carrying member for guiding and supplying developer to a latent image on the surface of an image bearing member to cause the developer to adhere to the latent image, means for supplying a bias voltage to the developer carrying member, means for detecting the feed of multiple transfer mediums, and means for varying the bias voltage to the developer carrying member in response to the detecting operation of the multi-copy feed detecting means.

The above and other objects and features of the present invention will become more fully apparent from the following detailed description taken in conjunction with the accompanying drawings.

DESCRIPTION OF THE PREFERRED EMBODIMENT

An embodiment of the present invention will hereinafter be described with reference to the drawings.

Figure 1:
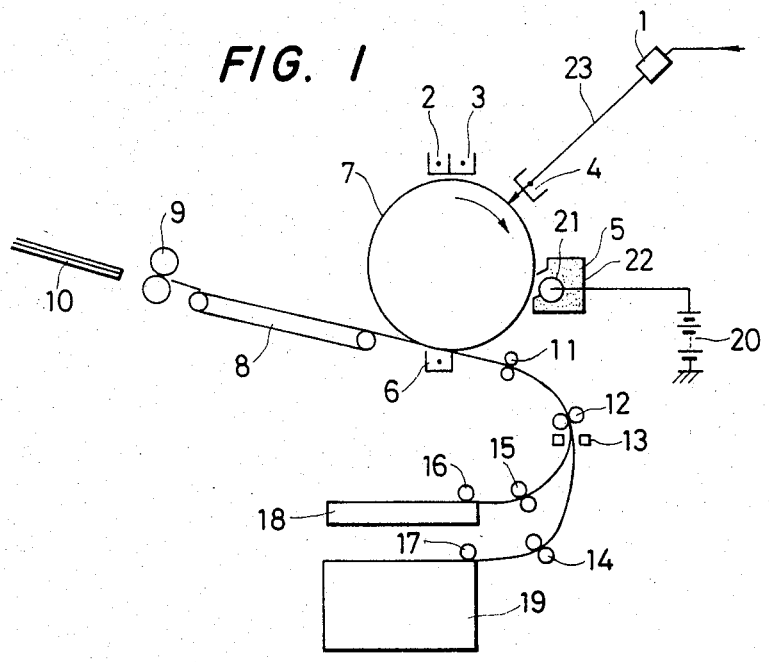
FIG. 1 is a schematic view of a laser beam printer illustrating an embodiment of the present invention.

FIG. 1 schematically shows the construction of a laser beam printer which is an image recording apparatus using the present invention. Describing the construction of the apparatus with the normal image recording operation thereof, reference numeral 7 designates a photosensitive drum as an image bearing member which is rotatable in the direction of arrow. Along the direction of rotation of the drum 7, there are disposed a predischarger 2, a primary charger 3 and a secondary charger 4. By the secondary charger 4, a latent image corresponding to a laser beam 23 applied from a laser oscillator 1 may be formed on the surface of the drum.

Figure 3:
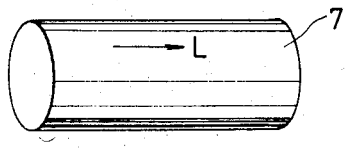
FIG. 3 is a perspective view of the drum.

The laser beam 23 is turned on and off correspondingly to a video signal and is scanned along the axial direction L of the drum 7 shown in FIG. 3. If the video signal is the image information to be read, a latent image corresponding to the read image will be formed on the surface of the drum 7 by the rotation of the drum 7 and the scanning operation of the laser beam 23.

The latent image is formed in the form of a potential and, when the latent image passes by a developing device 5 due to the rotation of the drum 7, toner 22 charged to the negative (−) polarity adheres to the surface of the drum in accordance with the latent image. Designated by 21 is a developing sleeve connected to a bias voltage source 20 and maintained at a somewhat high potential.

In the present laser beam printer, copy paper may be supplied from any of a cassette 18 and a deck 19, but for convenience of description, it is to be understood that the copy paper is supplied from the deck 19. A sheet of copy paper fed from the deck by rotation of a paper feed roller 17 has its leading end edge registered by register rollers 14 and is passed between conveyor rollers 12, 12 and has its leading end edge again registered by timing rollers 11 and arrives at the surface of the drum 7. Thereupon, the afore-mentioned toner on the drum surface is transferred onto the copy paper by an image transfer charger 6, and then the copy paper is carried to a fixing device 9 by conveyor means 8. The toner on the copy paper is fixed by the fixing device 9, whereafter the copy paper is discharged onto a tray 10.

Figure 2:
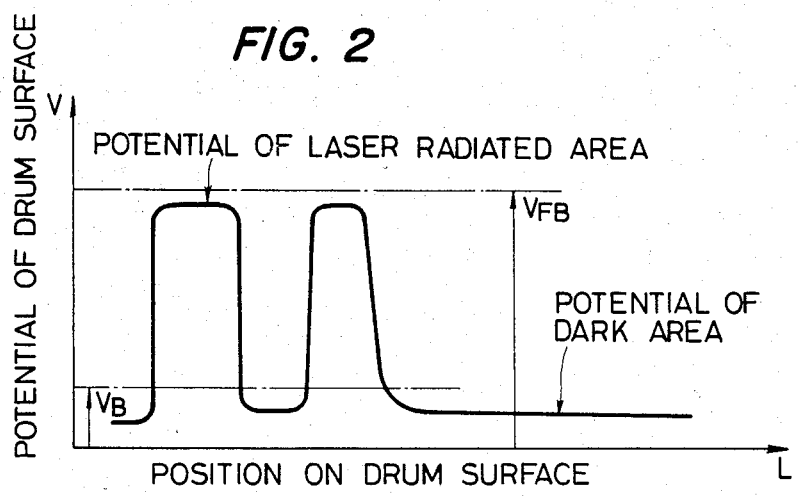
FIG. 2 is a graph showing the relation between the potential of the photosensitive drum surface and the potential of the developing sleeve.

FIG. 2 is a graph illustrating the potential of the drum surface and the adherence of the toner to the drum surface in the above-described image recording. In FIG. 2, the abscissa represents the positions along the axis of the drum and the ordinate represents the potential of the drum surface which has arrived at the developing device. Also, in FIG. 2, the dot-and-dash line indicates the potential of a sleeve 21 which is a developer carrying member. This potential is supplied from a power source 20 and assumes a value indicated by $V_B$ during the normal image recording operation. Further, the toner is charged to the negative (−) polarity by the friction thereof with the rotating developing sleeve. The surface potential of the drum 7 is such that the portion thereof irradiated with the laser is at a high potential and the portion thereof not irradiated with the laser is at a low potential, as shown in FIG. 2. Thus, the toner charged to the negative (−) polarity adheres to the portion of the drum surface irradiated with the laser, but the potential of the dark area is lower than the potential $V_B$ of the developing sleeve 21 and therefore, no toner adheres to this portion (i.e., the portion not irradiated with the laser).

As will be understood from the foregoing description, if the application of the laser beam is released, the potential of the surface of the photosensitive drum 7 is kept at the dark area potential and thus, the adherence of the toner, in other words, the supply of the toner from the developing device 5 to the photosensitive drum 7, does not take place as a rule and, if the potential of the developing sleeve 21 is varied to the high potential condition indicated by $V_{FB}$ in FIG. 2, the supply of the toner does not take place even if the drum surface has a laser-irradiated potential portion.

In the present invention, this is utilized in the following manner to inhibit the supply of the toner when multi-copy feed is detected.

The image recording apparatus to which the present invention is applied, like the laser beam printer shown in FIG. 1, is provided with a multi-copy feed detecting device designated by 13 in FIG. 1. This multi-copy feed detecting device 13 is of the type which compares the quantity of light transmitted through the copy paper passed previously and the quantity of light transmitted through the copy paper passed next time and detects the passage of the copy paper as multi-copy feed if the quantity of light transmitted therethrough is reduced. This detecting device 13 may also use another type of detecting means (such as a detecting means which compares the quantity of light transmitted through the copy paper with the reference quantity of transmitted light or detecting means which detects the conveyance length of the copy paper).

In the present invention, if multi-copy feed is detected by the multi-copy feed detecting device 13, the laser beam is turned off to release the operation of forming a latent image on the drum surface and further, the potential of the developing sleeve 21 is increased to the value of $V_{FB}$ shown in FIG. 2, whereby adherence of the toner to the drum surface is inhibited.

As is already apparent from what has been described hereinbefore, the supply of the toner is also substantially released by only the high potential switching operation of the developing sleeve 21 and thus, the object of the present invention is sufficiently achieved. In this case, however, the image writing into the photosensitive drum 7 becomes meaningless and release of the writing-in is preferable for the release of the toner supply and therefore, it is practically desirable that the release of the image writing-in be effected at the same time.

Figure 4:
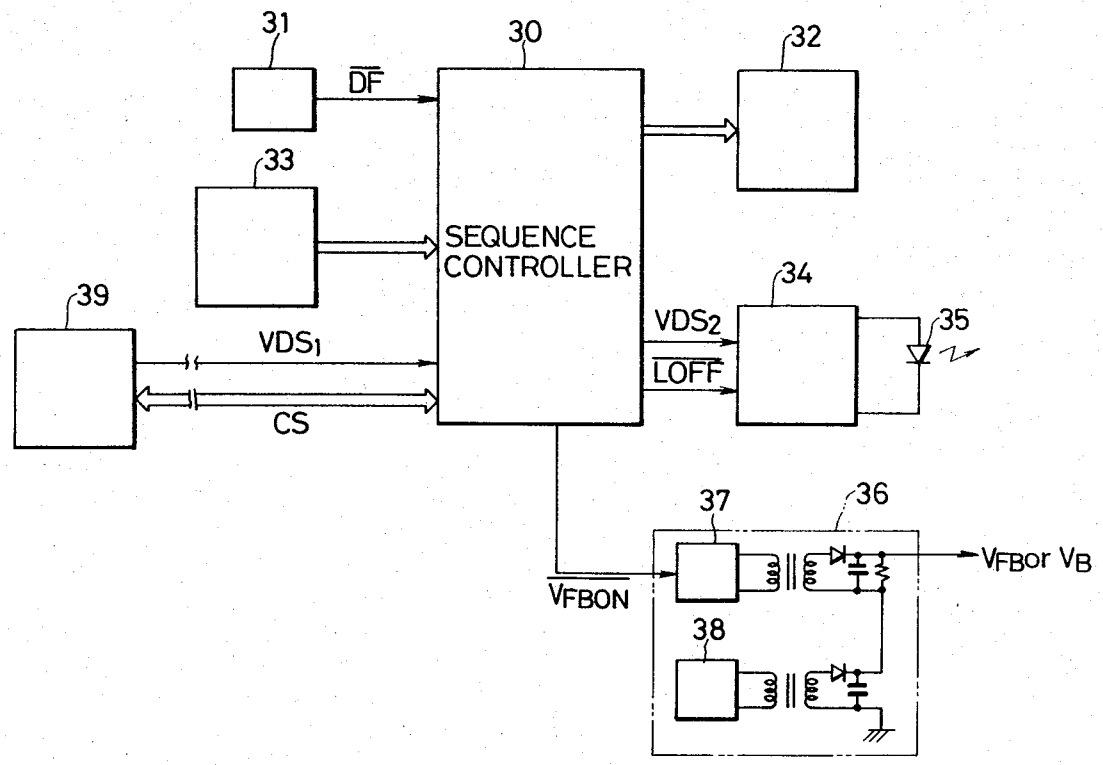
FIG. 4 is a block diagram showing the control unit according to the present invention.

FIG. 4 shows a control circuit for changing over the potential of the developing sleeve 21 from $V_B \rightarrow V_{FB}$ in response to the detecting operation of the multi-copy feed detecting device 13. In the present embodiment, the writing of the laser beam into the drum 7 may also be released by detection of multi-copy feed.

In FIG. 4, reference numeral 30 designates a sequence controller for controlling the operation of the present apparatus. The sequence controller has the sequence controlling function for effecting appropriate continuous operation of each driving unit in the apparatus or the function of monitoring any abnormality of the apparatus. Further, the sequence controller receives a data signal $VDS_1$ from an external instrument 39 and effects the data processing for carrying out an operation corresponding to said signal. Signal CS is a control signal between the external instrument 39 and the sequence controller 30. Designated by 33 is a detecting circuit portion which puts out a sense signal (such as a drum clock signal or a paper detection signal) from each block applied as input to the sequence controller 30. Denoted by 32 is a driving circuit for driving each driving portion in accordance with a drive signal put out by the sequence controller 30. Reference numeral 31 designates a multi-copy feed detecting circuit which puts out a signal $\overline{DF}$ to the sequence controller 30 if multi-copy feed is detected by the multi-copy feed detecting device 13 during printing. Reference numeral 34 denotes a driving circuit for a semiconductor laser 35. A video signal $VDS_2$ and a signal $\overline{LOFF}$ for commanding the ON-OFF of the semiconductor laser are applied as inputs to the driving circuit 34 from the sequence controller 30. Denoted by 36 is a circuit which produces two types of developing bias potentials $V_{FB}$ and $V_B$ in the present invention. Reference numerals 37 and 38 designate oscillators. The oscillator 37 has the function of stopping its oscillating operation by a signal $\overline{V_{FBON}}$ from the sequence controller. That is, when both oscillators 37 and 38 are oscillating, the developing bias potential becomes $V_{FB}$ and, when the oscillator 37 is stopped from oscillating, the develoing bias potential becomes $V_B$.

Figure 5:
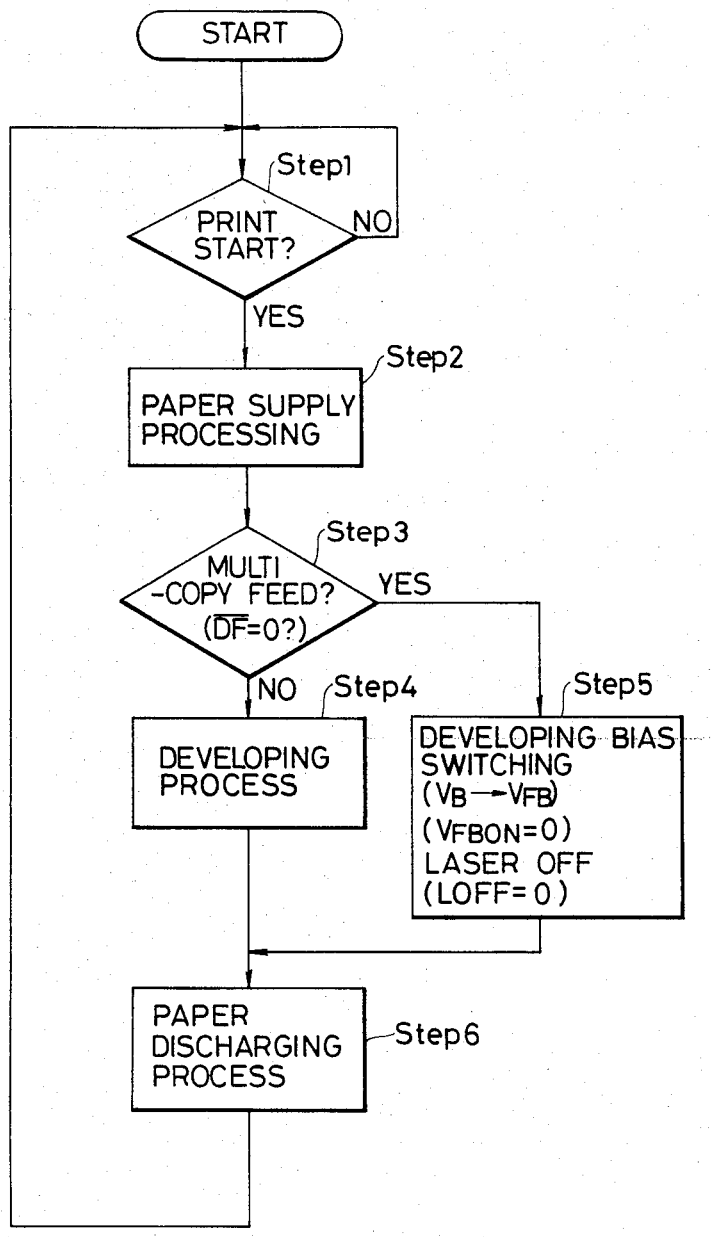
FIG. 5 is a flow chart of the present invention.

FIG. 5 shows a flow chart for carrying out the sequence of multi-copy feed detection and developing bias processing in the present invention. At step 1, printing operation is started by a print start instruction, whereupon copy paper is fed from the paper supply source to the conveyance path in the paper supply processing course of step 2. At step 3, the presence or absence of multi-copy feed is judged. In the present embodiment, the multi-copy feed detecting device 13 is disposed immediately before the conveyor rollers 12 and therefore, during this paper supply processing, the presence or absence of multi-copy feed is detected by the sequence controller 30 at a timing immediately before the copy paper passes between the conveyor rollers 12. This is done by checking a multi-copy feed signal $\overline{DF}$. If multi-copy feed is not detected here, the printing operation is completed via the developing process and the paper discharge processing course at steps 4 and 6. If multi-copy feed is detected at step 3, the developing bias potential is changed over from $V_B$ to $V_{FB}$ in the developing bias change-over processing course of step 5 and further, the light emission of the laser is stopped, whereby the operation of inhibiting the adherence of the toner to the copy paper is effected. At step 6, the copy paper is discharged via the paper discharge processing.

According to the image recording apparatus of the present invention, as described above, when multi-copy feed is detected, the previously described operation is assumed to thereby eliminate the adherence of the toner to the drum surface or the copy paper and, whenever jam is caused near the drum by multi-copy feed, such jam can be clearly dealt with and waste of the toner during multi-copy feed is eliminated, and this leads to reduced consumption of the toner.

Also, when multiple copy sheets fed at a time are discharged onto the tray without any trouble, these multiple copy sheets have of course no image recorded thereon, and this is very effective to keep secrecy.

We claim:

1. An image recording apparatus having:

a developer carrying member for guiding and supplying developer to a latent image on the surface of an image bearing member to cause the developer to adhere to said latent image;

means for supplying a bias voltage to said developer carrying member;

means for detecting the feed of multiple transfer mediums; and means for varying the bias voltage to said developer carrying member in response to the detecting operation of said multi-copy feed detecting means.

2. An image recording apparatus according to claim 1, wherein formation of the latent image on the surface of said image bearing member is inhibited in response to the detecting operation of said multi-copy feed detecting means.

* * * * *